US007456792B2

(12) United States Patent
Baliarda et al.

(10) Patent No.: US 7,456,792 B2
(45) Date of Patent: Nov. 25, 2008

(54) HANDSET WITH ELECTROMAGNETIC BRA

(75) Inventors: Carles Puente Baliarda, Barcelona (ES); Jaume Anguera Pros, Castellon (ES)

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 10/588,640

(22) PCT Filed: Feb. 28, 2005

(86) PCT No.: PCT/EP2005/002075

§ 371 (c)(1),
(2), (4) Date: Sep. 8, 2006

(87) PCT Pub. No.: WO2005/083833

PCT Pub. Date: Sep. 9, 2005

(65) Prior Publication Data

US 2007/0159401 A1 Jul. 12, 2007

Related U.S. Application Data

(60) Provisional application No. 60/567,615, filed on May 3, 2004, provisional application No. 60/548,050, filed on Feb. 26, 2004.

(51) Int. Cl.
*H01Q 1/24* (2006.01)

(52) U.S. Cl. ..... 343/702; 343/700 MS; 343/846

(58) Field of Classification Search ..... 343/702, 343/846, 700 MS; 455/90
See application file for complete search history.

(56) References Cited

U.S. PATENT DOCUMENTS 4,504,834 A 3/1985 Garay et al.
4,518,968 A 5/1985 Hately et al.
5,347,291 A 9/1994 Moore
6,100,855 A 8/2000 Vinson et al.

(Continued)

FOREIGN PATENT DOCUMENTS

EP 1067627 1/2001

(Continued)

OTHER PUBLICATIONS

Lindberg, Peter et al, "A Bandwidth Enhancement Technique for Mobile Handset Antennas Using Wavetraps", IEEE Transactions on Antennas and Propagation, vol. 54, No. 8, Aug. 2006, pp. 2226-2233.

(Continued)

*Primary Examiner*—Hoang V Nguyen
(74) *Attorney, Agent, or Firm*—Winstead PC

(57) ABSTRACT

The present invention relates to a handset and generally of any handheld device, which includes an antenna for receiving and transmitting electromagnetic wave signals. More in particular, the invention is related to handsets of the clamshell or flip-phone type. An electromagnetic bra structure is introduced to correct the position of the lobes of the handheld radiation pattern, so that the radiation and sensitivity of the hand held device is increased in the horizontal plane or generally to the other desired directions. The electromagnetic bra structure comprises at least one conducting surface arranged over at least one side of a ground plane of the handset, so that a resonance circuit having a high impedance at an operating frequency of the antenna is establish, to block currents and electromagnetic fields from entering a region of the ground plane.

29 Claims, 12 Drawing Sheets

U.S. PATENT DOCUMENTS

| | | | |
|---|---|---|---|
| 6,191,751 | B1 | 2/2001 | Johnson |
| 6,314,273 | B1 | 11/2001 | Matsuda et al. |
| 6,421,016 | B1 | 7/2002 | Phillips et al. |
| 6,426,722 | B1 | 7/2002 | Sievenpiper et al. |
| 6,456,249 | B1 | 9/2002 | Johnson et al. |
| 6,483,480 | B1 | 11/2002 | Sievenpiper et al. |
| 6,483,481 | B1 | 11/2002 | Sievenpiper et al. |
| 6,518,931 | B1 | 2/2003 | Sievenpiper |
| 6,538,621 | B1 | 3/2003 | Sievenpiper et al. |
| 6,552,696 | B1 | 4/2003 | Sievenpiper et al. |
| 6,670,921 | B2 | 12/2003 | Sievenpiper et al. |
| 6,670,932 | B1 | 12/2003 | Diaz et al. |
| 6,690,327 | B2 | 2/2004 | McKinzie, III et al. |
| 6,774,866 | B2 | 8/2004 | McKinzie, III et al. |
| 2001/0033250 | A1 | 10/2001 | Keilen et al. |
| 2003/0071763 | A1 | 4/2003 | McKinzie et al. |
| 2003/0142036 | A1 | 7/2003 | Wilhelm et al. |
| 2003/0174092 | A1 | 9/2003 | Sullivan et al. |
| 2004/0037052 | A1 | 2/2004 | Wu et al. |

FOREIGN PATENT DOCUMENTS

| | | | |
|---|---|---|---|
| EP | 1172884 | A2 | 1/2002 |
| EP | 1 403 960 | | 3/2004 |
| GB | 2112579 | | 7/1983 |
| WO | WO-9839814 | | 9/1998 |
| WO | 9950929 | A1 | 10/1999 |
| WO | WO-01/22528 | | 3/2001 |
| WO | WO-01/54225 | | 7/2001 |
| WO | 02087012 | A1 | 10/2002 |
| WO | WO-02/084784 | | 10/2002 |
| WO | WO-03/023900 | | 3/2003 |
| WO | WO-03026064 | | 3/2003 |
| WO | WO-04/001894 | | 12/2003 |

OTHER PUBLICATIONS

Icheln, Use of balun chokes in small-antenna radiation measurements, IEEE Transactions on Instrumentation and Measurement, Apr. 2004, vol. 53, No. 2.

Kivekas, Design of high-efficiency antennas for mobile communications devices, Helsinki University of Technology, Aug. 2005.

Zhang, L. et al. Blindness free phased array design using PCB materials, IEEE Tranasactions on Antennas and Propagation, Aug. 2004, vol. 52, No. 8.

(PRIOR-ART)

(PRIOR-ART)

(PRIOR-ART)

(PRIOR-ART)

(PRIOR-ART)

d c a b

HANDSET WITH ELECTROMAGNETIC BRA

CROSS-REFERENCE TO RELATED APPLICATIONS

This application is a 371 of PCT/EP05/02075 dated Feb. 28, 2005.

This patent application claims the benefit of priority from U.S. Provisional Patent Application Ser. No. 60/548,050 filed on Feb. 26, 2004 and U.S. Provisional Patent Application Ser. No. 60/567,615 filed May 3, 2004. This application incorporates by reference the entire disclosure of U.S. Provisional Patent Application Ser. No. 60/548,050 and U.S. Provisional Patent Application Ser. No. 60/567,615.

OBJECT OF THE INVENTION

The present invention relates to a handset and generally of any handheld device, which includes an antenna for receiving and transmitting electromagnetic wave signals. More in particular, the invention is related to handsets of the clamshell or flip-phone type.

It is an object of the present invention to provide a handset or handheld device, which incorporates means to correct the tilting and distortion of the radiation pattern lobes, so that the radiation and sensitivity of the hand held device is increased in the horizontal plane or generally to the other desired directions.

BACKGROUND OF THE INVENTION

The radiation pattern of a handset (and generally of any handheld device that includes an antenna for receiving and transmitting electromagnetic wave signals) is determined, among other factors, by the antenna shape, its position on the handset, and also the handset size and its physical construction. Usually, the antenna is placed at an edge of the handset to maximize radiation. Such an edge is usually the top part of the handset (near the earphone) although can also be in some cases the bottom part (near the speaker). This way, the combination of such a position together with the size of the handset, and in particular the size of the grounding metals inside the handset (mainly printed circuit boards and electromagnetic shields), usually determine the shape of the pattern.

The example shown in FIG. 1 describes this fact. FIG. 1 is a simplified model of a handset, including a printed circuit board (PCB) for the conducting ground (1) (wider rectangle on the left), and a whip antenna (2) (narrow strip on the right) which is typically a quarter of a wavelength in length.

Typical radiation patterns for such a handset are shown in FIG. 2. Such a pattern shows a vertical cut (XZ plane) on the handset, with the top part (antenna) place on the right side of the horizontal X axis, and the handset body on the left size of same axis.

It is seen on such a plot that typically the radiation pattern is tilted towards the lower part of the handset. That is, radiation is enhanced below horizon (vertical axis on the graph) which is an inconvenient when receiving and transmitting from long distance base stations, since in these cases radiation comes from the vicinity of a horizontal plane (ZY plane). This phenomenon is related to the distribution of currents flowing on the handset, which are asymmetrically split between the antenna and the casing (PCB, shieldings) of the phone. Again, the antenna position, together with the PCB and handset size, are the determining effects contributing to this phenomenon.

This problem becomes even more relevant when the handset is of the clamshell or flip-phone type. In clamshells phones, the keyboard and screen are usually split in two parts that unfold apart by means of a hinge connecting said two parts. Both parts of the phone include metal parts (PCB, shieldings) and are interconnected by means of a flexible circuit or wire set. When such a type of handheld is unfolded, the overall length of the metal part (typically the PCB ground) is increased, which again influences the shape of the radiation pattern. This example of a handset and pattern distortion effect is shown in FIGS. 3, 4 and 5.

FIG. 4 shows a typical difference between the folded and unfolded phone radiation patterns in the horizontal plane (YZ). The unfolded phone radiates (and receives) a weaker signal (smaller circle) in the horizontal plane than the folded one. This is due to a pattern distortion in the vertical plane (XZ) as shown in FIG. 5. The new pattern displays a minimum radiation on the horizontal plane, while steering radiation to other for quadrants in space. This effect can be even more significant when a handset integrates a small internal antenna.

Some structures known in the prior art, such as multilevel structures, space-filling curves or the ground planes described in the PCT publication WO03023900, can be advantageously used in the present invention.

The PCT publication WO0122528 describes a multilevel structure for an antenna device consisting of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles and ellipses are included as well, since they can be understood as polygons with a very large (ideally infinite) number of sides.

The PCT publication WO0154225 describes a space-filling curve SFC: as a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the gap according to the present invention, the segments of the SFC curves included in said multilevel structure must be shorter than a tenth of the free-space operating wavelength.

The PCT publication WO03023900 describes a groundplane for an antenna device, comprising at least two conducting surfaces, said conducting surfaces being connected by at least a conducting strip, said strip being narrower than the width of any of said two conducting surfaces.

SUMMARY OF THE INVENTION

The present invention provides means to correct such a tilting and distortion of the radiation pattern lobes, such as radiation and sensitivity of the handheld device is increased in the horizontal plane, or generally to other desired directions. An electromagnetic bra structure (EBS) is introduced in the present invention to correct the position of the lobes of the handheld radiation pattern.

A first aspect of the present invention refers to a handset for radio communication, which comprises an antenna and a ground-plane associated with the antenna, the antenna being situated in correspondence with an antenna end of the ground-plane. Said handset is characterised in that it comprises an electromagnetic bra structure which comprises at least one conducting surface situated over a part of the ground-plane and separated from said part of the ground-plane. Said at least one conducting surface is arranged so that said part of the ground-plane and said at least one conducting surface, in combination, establish a resonance circuit having a high impedance at an operating frequency of the antenna, towards the antenna end of the ground plane.

Due to this high impedance, operating frequency currents are substantially prevented from flowing into said part of the ground-plane, whereby said part of the ground-plane is prevented from influencing the radiation pattern. This provides for a virtually shorter ground-plane from the electromagnetic point of view, as part of the entire physical ground-plane will be functionally "disconnected" at the operating frequency. Consequently, the pattern shape is changed in the desired direction and a dramatic increase in the radiation, for example in the horizontal plane, is obtained.

Said conducting surface may be short-circuited to the ground-plane at a position situated at a distance from an end of the conducting surface facing the antenna end of the ground-plane, said distance being such that it corresponds to an electric path length of substantially one quarter of the wavelength at the operating frequency, or an odd multiple of a quarter of said wave length. Said short circuit can comprise an actual direct (galvanic) electrical connection or a virtual short-circuit providing a low impedance path between the ground-plane and the conducting surface at the operating frequency.

Optionally, said at least one conducting surface is not short-circuited to the ground-plane, and said at least one conducting surface is arranged such that said resonance circuit has a first open end facing the antenna end of the ground-plane, and a second open end separated from said first open end, by a distance corresponding to an electrical path length substantially equal to half of the wavelength, or a multiple of said half of the wavelength, at the operating frequency.

It should be stressed that such an EBS should not be confused with a conventional EMI shield, which completely encases a part of a circuit inside an electromagnetic cage. Such a conventional shielding, instead of blocking currents and electromagnetic fields, would conduct currents on top of its surface not raising (pushing-up) properly the lobes as in the case of the Electromagnetic Bra Structure. In the EBS, due to the high impedance resonance circuit established by said at least one conducting surface in cooperation with the ground plane, electric currents and electromagnetic fields are blocked from entering the region of the ground plane covered by said at least one conducting surface.

Another aspect of the invention refers to a method of producing the above-described handset for radio communication. The method comprises the step of arranging at least one conducting surface over a part of the ground-plane and separated from said part of the ground-plane, so that said part of the ground-plane and said at least one conducting surface, in combination, establish a resonance circuit having a high impedance at an operating frequency of the antenna, towards the antenna end of the ground plane.

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but just as an example of how the invention can be embodied. The drawings comprise the following figures:

FIG. 12*a* array of parallel strips with ground plane and open edge towards the ground plane interconnection; FIG. 12*b* two parallel strip EBS at the edges of the ground plan; FIG. 11*c* single strip EBS; FIG. 11*d* rib-like EBS with strips perpendicular to the central axis of the handset, FIG. 11*e* similar embodiment as in FIG. 11*a* but with strips of different length.

DESCRIPTION OF THE PREFERRED EMBODIMENT OF THE INVENTION

Figure 1:
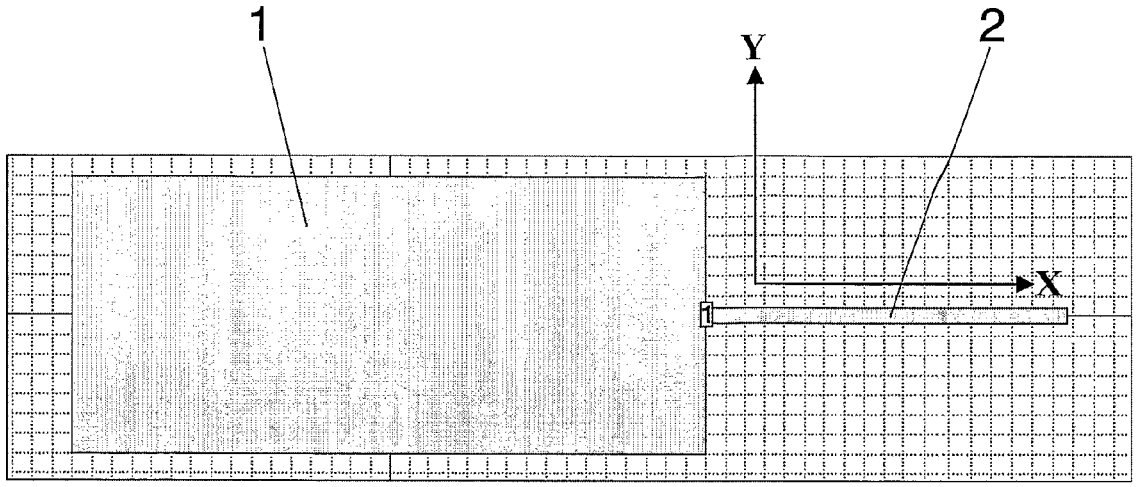
FIG. 1.—shows a simplified model of a prior-art handset including an antenna (narrow strip on the right). X and Y axes are shown for reference.
Figure 2:
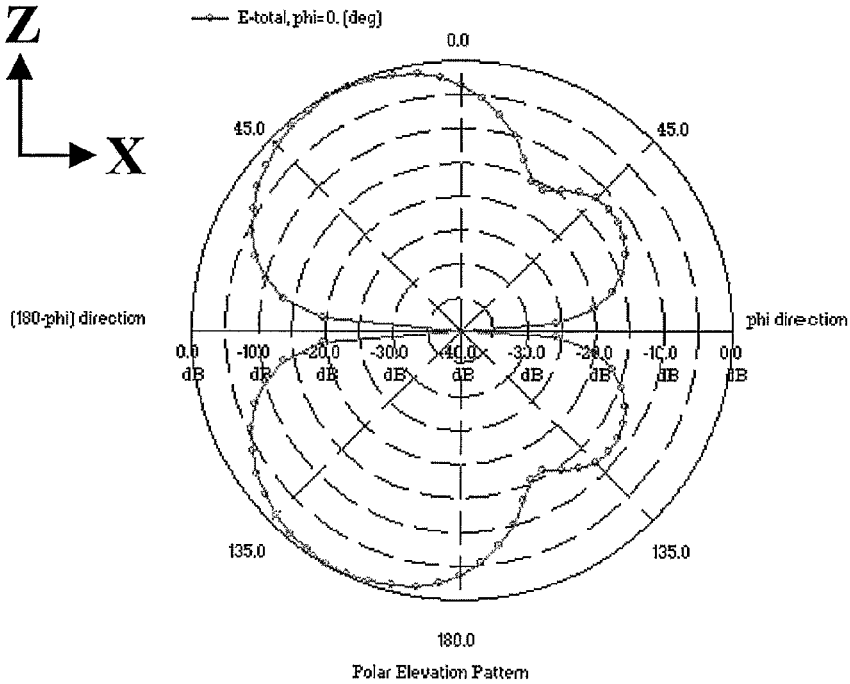
FIG. 2.—shows a vertical cut (XZ plane) of a typical radiation pattern of a handset structure as per that on FIG. 1.
Figure 3:
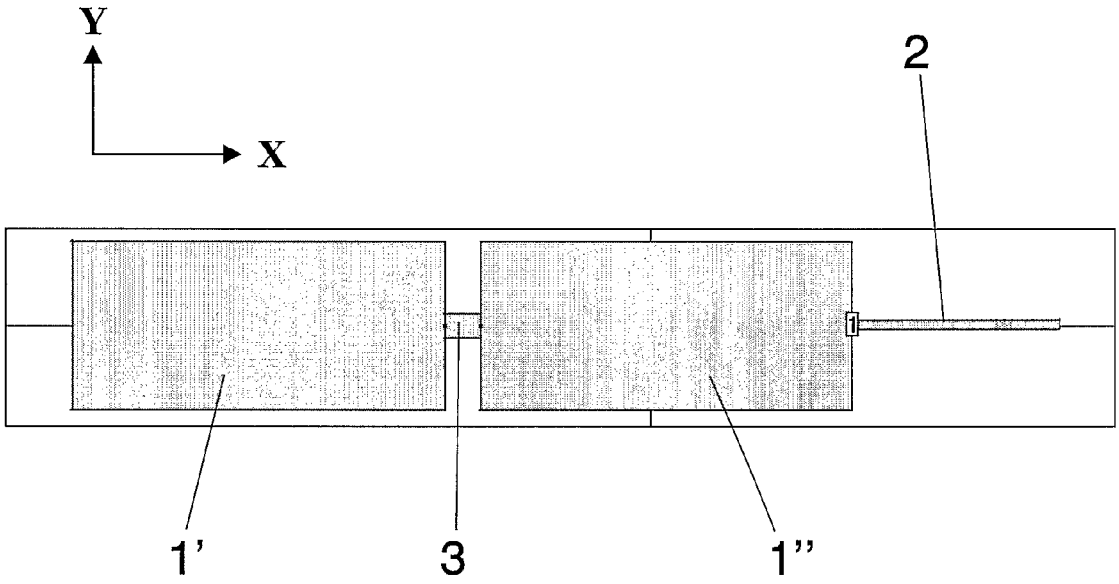
FIG. 3.—shows an unfolded model of a prior-art clamshell phone. The unfolded phone forms a longer electromagnetic ground plane for the antenna.
Figure 4:
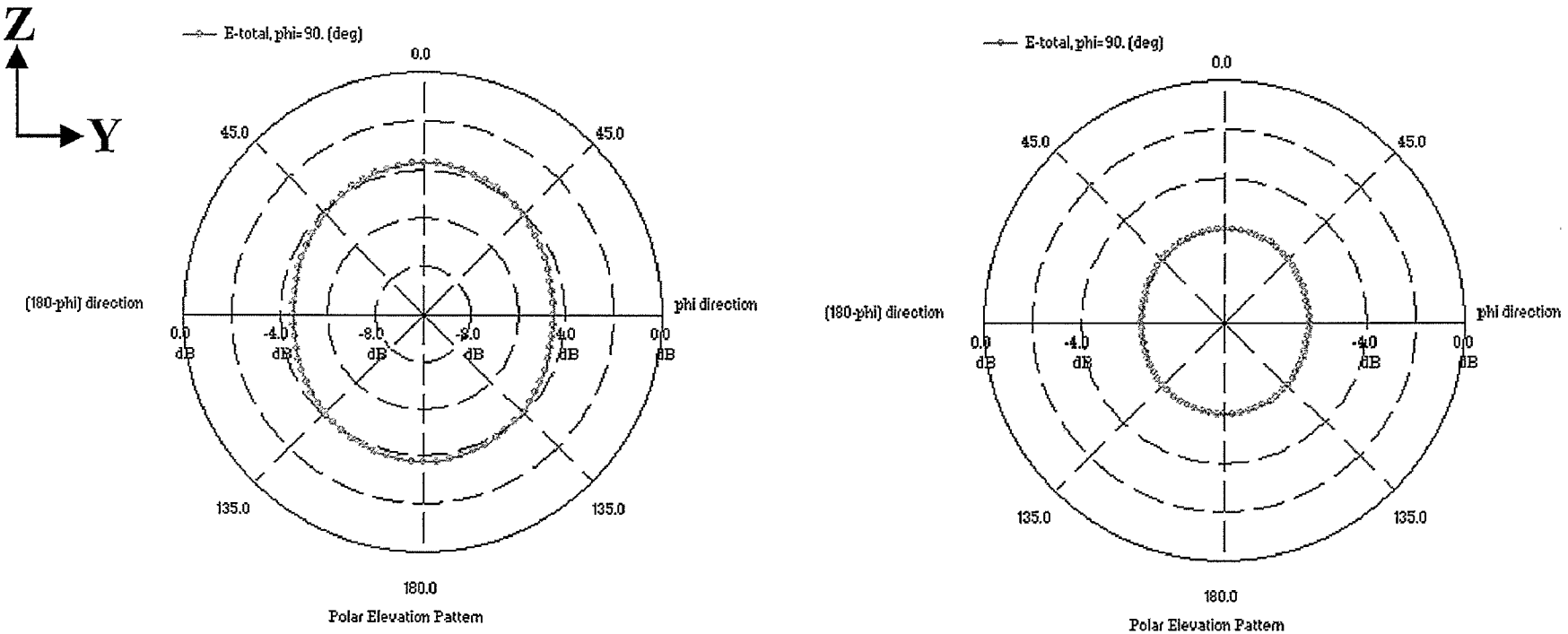
FIG. 4.—shows a horizontal cut of the radiation pattern of a folded (FIG. 4*a*) and unfolded (FIG. 4*b*) clamshell phone.
Figure 5:
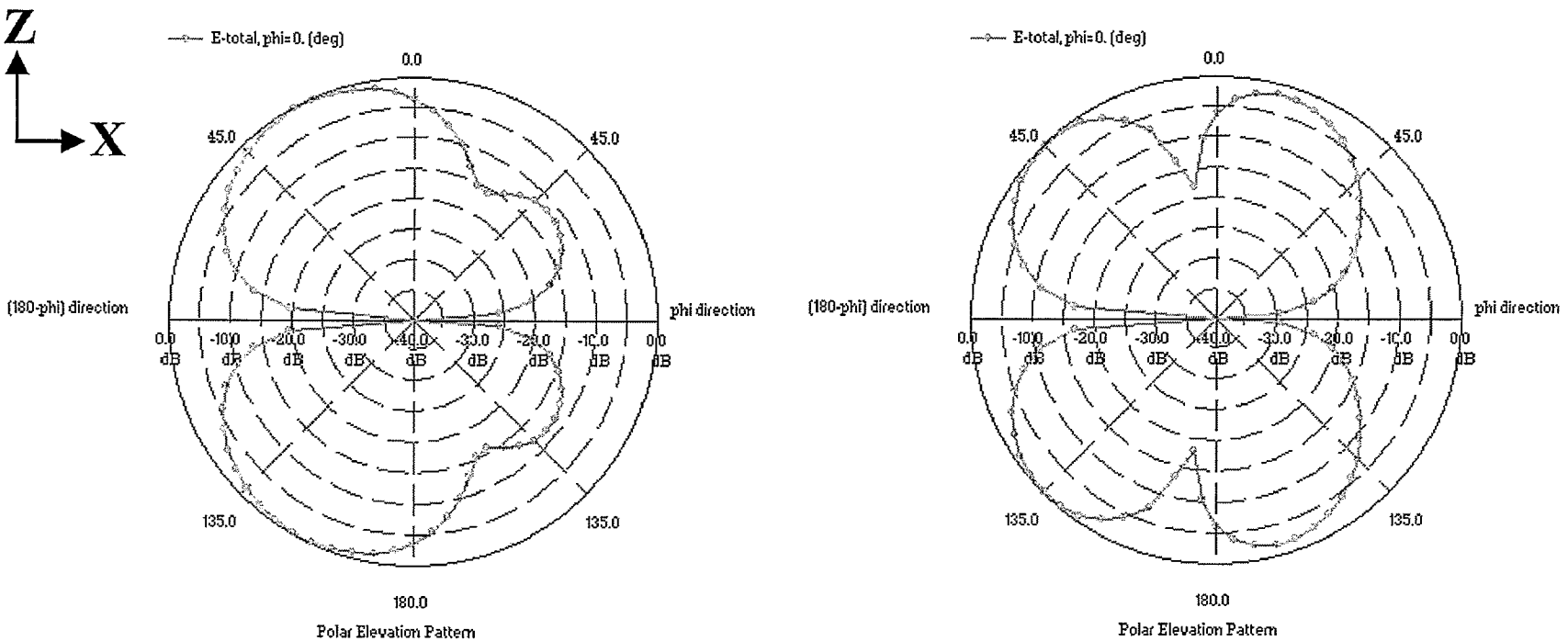
FIG. 5.—shows a vertical cut of the radiation pattern of a folded (FIG. 5*a*) and unfolded (FIG. 5*b*) clamshell phone.
Figure 6:
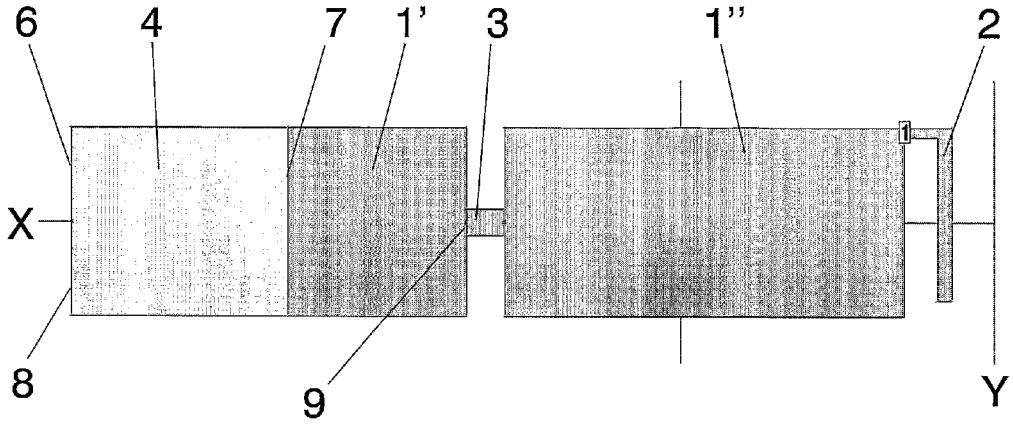
FIG. 6.—shows a top view of an unfolded phone with internal L-shaped antenna and with an EBS at the opposite side.
Figure 7:
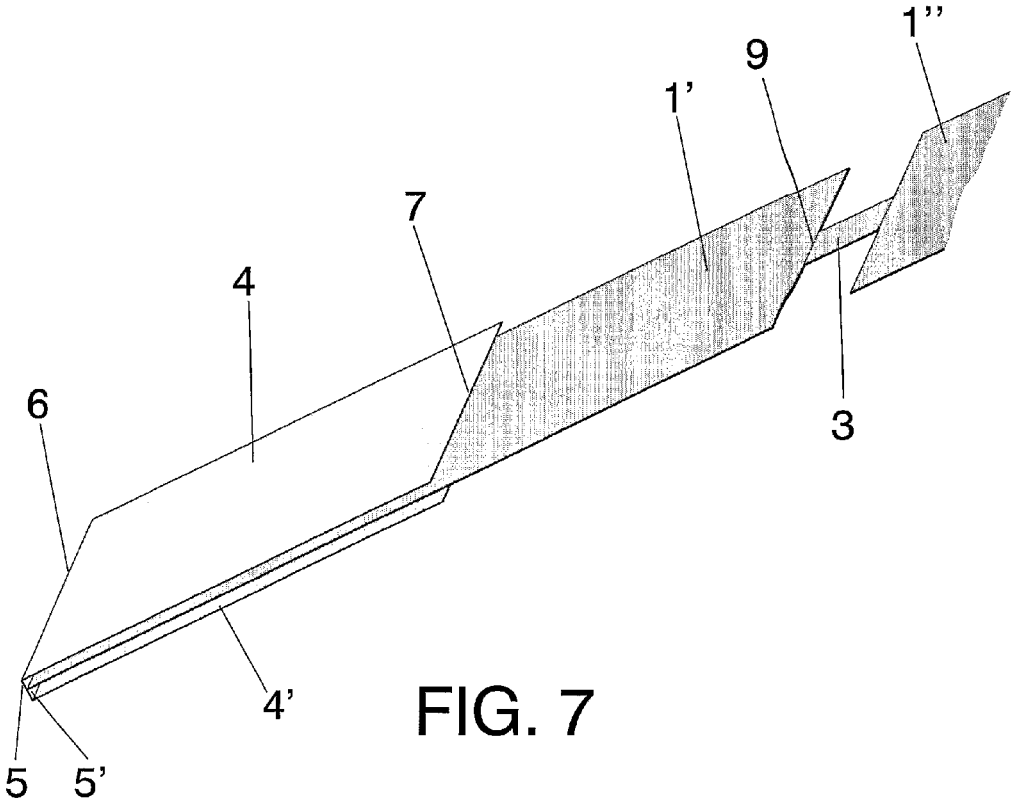
FIG. 7.—shows a perspective view of a lower portion of the handheld model in FIG. 6.

One preferred embodiment of an electromagnetic bra structure EBS, is shown in FIG. 6 and FIG. 7. FIG. 6 shows an unfolded clamshell phone with an L-shaped internal antenna (2) on the right side. The skilled in the art will notice that the following technique can be used with any other kind of antenna. For instance it can be combined with whip, PIFA, IFA, multilevel, space-filling, fractal, meander and other kind of antennas.

In the embodiment shown FIGS. 6 and 7, it can be observed the antenna (2) and the ground plane (1) comprising a first conducting part (1') and a second conducting part (1"), said first and second conducting parts being electrically connected by at least a conducting strip (3), said strip being narrower than the width of any of said first and second conducting parts (1',1"). The Electromagnetic Bra Structure in this particular embodiment, is formed by a first conducting surface (4) placed over one side of the first conducting part (1') of the ground plane, and a second conducting surface (4") placed over the other side of the first conducting part (1') of the ground plane.

The conducting surfaces (4,4") in this particular embodiment, are defined by a substantially rectangular conducting plate, and the first and second parts (1',1") of the ground plane (1) are also substantially rectangular. The conducting surfaces (4,4") are short-circuited respectively at one of their ends to the ground plane (1') by means of a first conducting plate (5) and a second conducting plate (5'), thereby the EBS (4,4',5,5') is formed by two L-shaped plates at both sides of the ground plane (1), said plates being electrically connected (shorted) to said ground plane nearby the bottom edge of the phone. Preferably, the conducting surfaces (4,4') on each side of the ground plane are a mirror image of each other.

Figure 8:
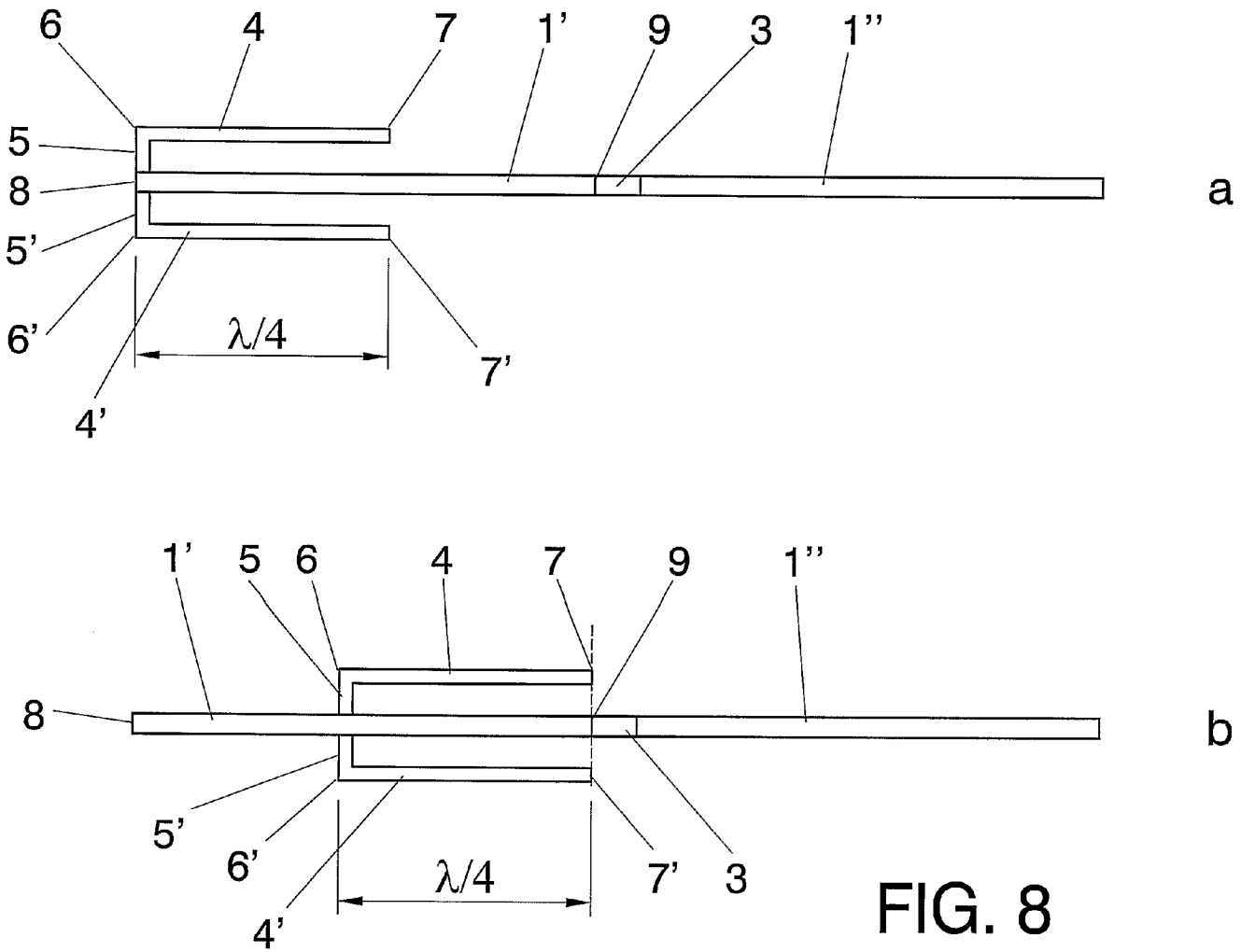
FIG. 8.—shows in FIG. 8*a* a side elevational view of the unfolded phone of FIGS. 6, and in FIG. 8*b* a side elevational view of the unfolded phone of FIG. 10.

In the embodiment represented in FIGS. 6, 7 and 8, the first conducting part (1') and a second conducting part (1") of the ground plane, and the conducting strip (3) are aligned along a longitudinal axis (x). The conducting surfaces (4,4') are also substantially rectangular and have the same width of the ground plane (1), and the short-circuited end (6) is placed right over the lower edge (8) of the first conducting part (1') and it is connected thereto, whereas the open end (7) is facing the conducting strip (3).

Typically, as indicated in FIG. 8, the length of the conducting plate defining the conducting surfaces (4,4') (longer arm of the L shape) is about (+/−20%) of a quarter of the wavelength from the short end (6) to the open end (7). Such a structure, that is the conducting surface arranged in cooperation over a part of the ground-plane, establish a resonance circuit having a high impedance at an operating frequency of the antenna, which blocks currents and electromagnetic fields from entering the region of the ground plane between the two surfaces (4,4'). That arrangement makes the whole set shorter from the electromagnetic point of view.

Figure 9:
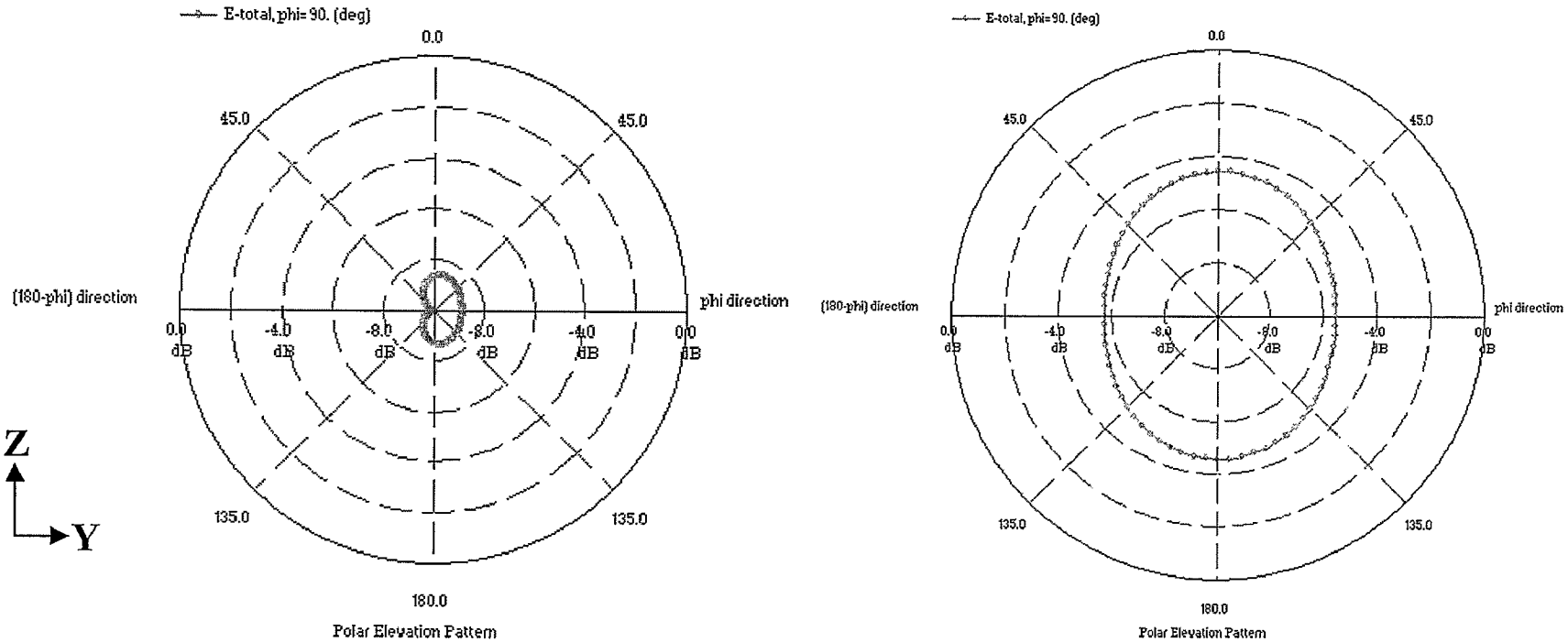
FIG. 9.—shows examples of the differences in radiation that can be obtained by using an EBS. Conventional structure features radiation patterns on the left side (FIGS. 9*a*, 9*c*), while patterns of handset including EBS are shown on the right (FIGS. 9*b*,9*d*).
Figure 9A:
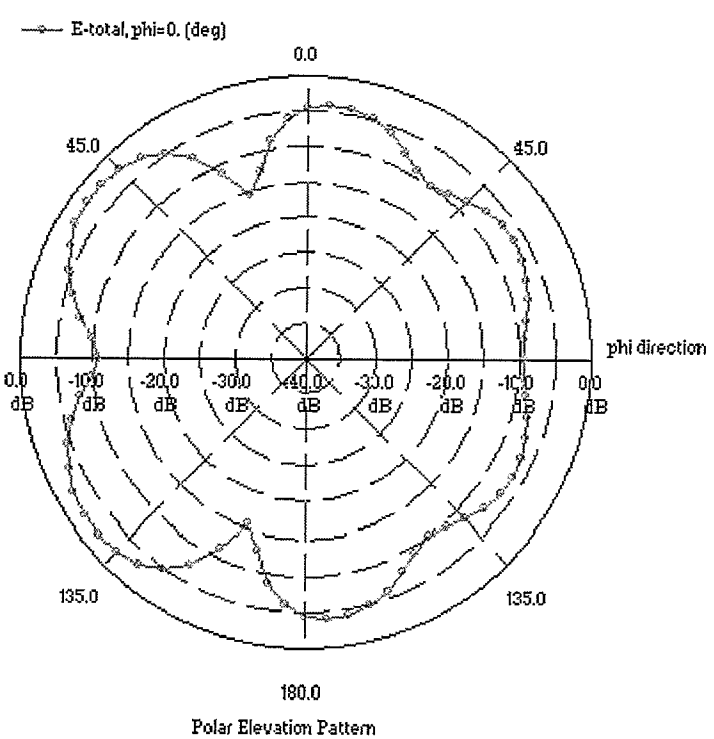
Figure 9A:
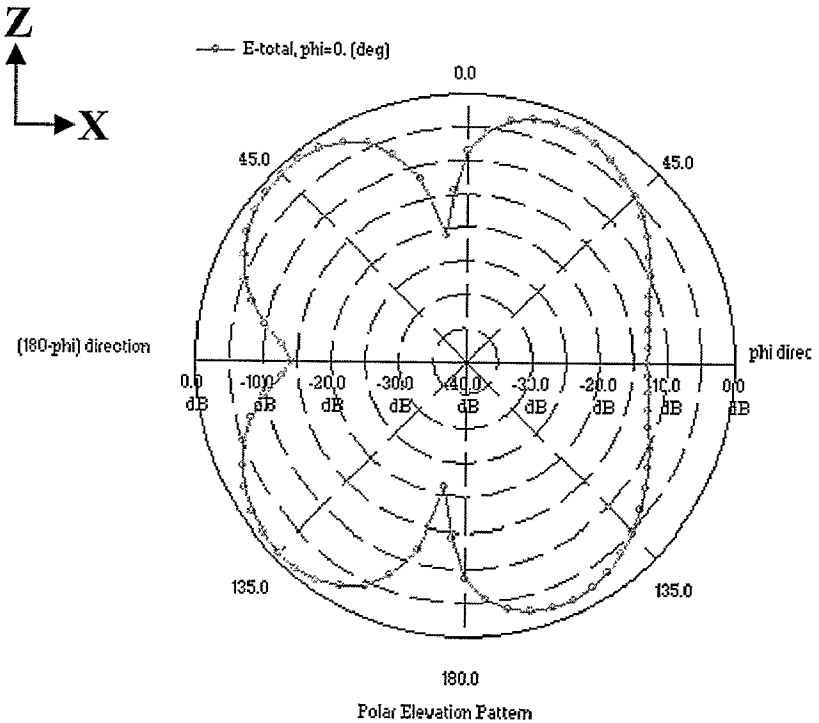

This effect is shown, without any limiting purpose, in the radiation patterns of FIG. 9. Original radiation pattern of handset with internal antenna without EBS is shown on FIGS. 9*a* and 9*c* (horizontal YZ cuts on FIG. 9*a*, vertical XZ cuts on FIG. 9*c*), while the patterns with the handset including such an EBS structure is shown on FIGS. 9*b*, 9*d*. Clearly, a local maximum of radiation is obtained in the horizontal plane where a minimum used to be before. This is observed in both cuts of the radiation pattern.

The pattern shaped can be changed for instance by modifying the shape of the EBS, its position on the ground plane or both. Therefore the conducting surfaces (4,4') may have any shape, and they can be defined by an outer perimeter comprising at least one straight segment and/or at least one curved line. Similarly, the ground plane (1) may adopt any shape, and it can be also defined by an outer perimeter comprising at least one straight segment and/or at least a curved line.

Figure 10:
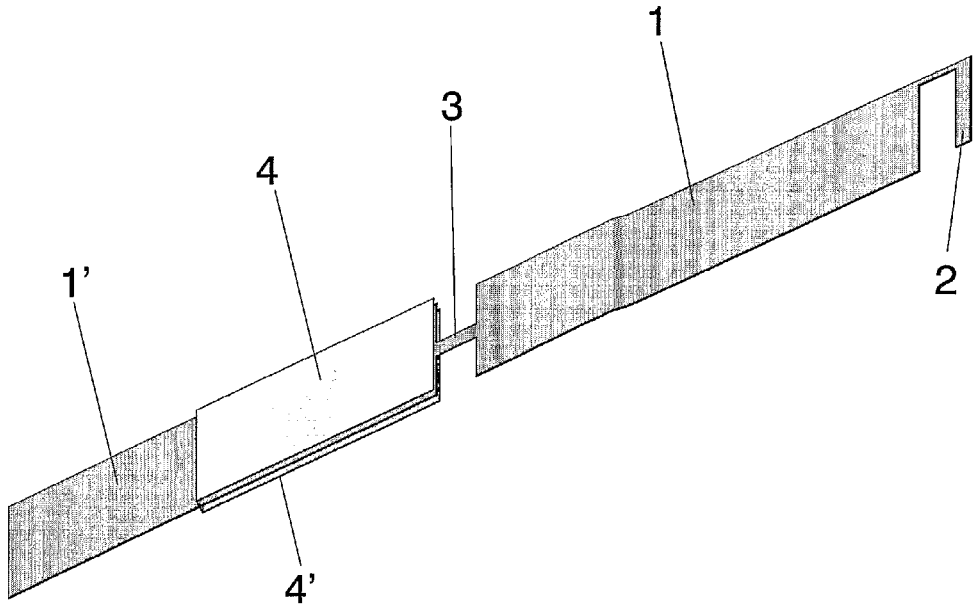
FIG. 10.—shows a perspective view of a handset with EBS placed in a middle region of the lower part of the ground plane. Open edge of EBS is placed by the strip interconnecting both parts of the ground plane, such the whole lower half of the handset becomes effectively disconnected.
Figure 11:
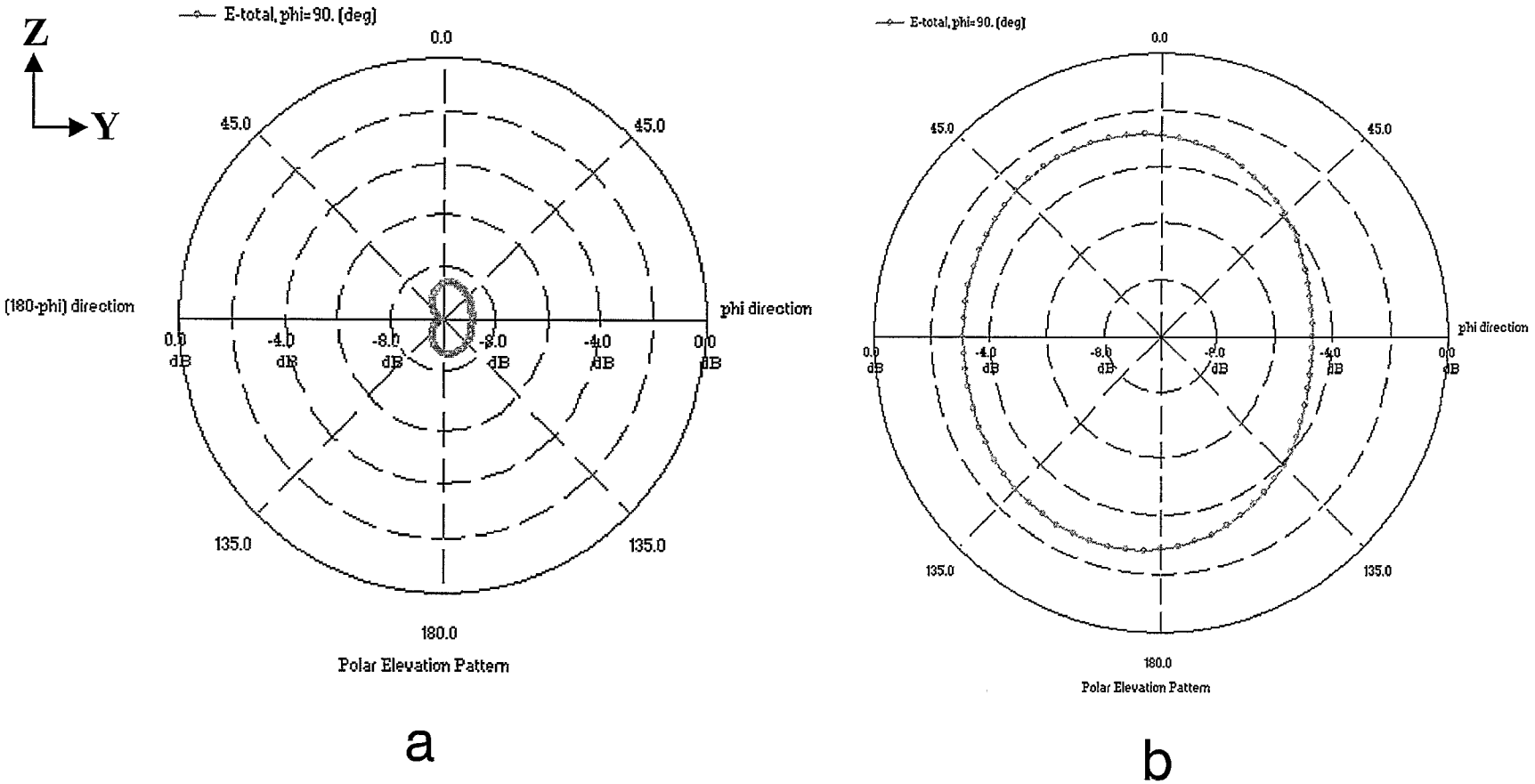
FIG. 11.—shows the increase of radiation (FIG. 11*b*) of the EBS in FIG. 10, compared with a conventional handset with no EBS (FIG. 11*a*).

FIG. 10 shows another embodiment where the EBS (4,4',5,5') is placed upper over the first conducting part (1') of the ground plane, so that the short-circuited ends (6,6') is connected to an inner part of said first conducting part (1'). The open ends (7,7') of the two plates defining the conducting surfaces (4,4') is placed just by the top of the first conducting part (1'), nearby its connection point (9) with the conducting strip (3), as shown in FIG. 8*b*. This way, the first conducting part (1') becomes effectively disconnected from the radiation point of view, and the pattern shape is changed again accordingly. Again, a dramatic increase on the radiation nearby the horizontal plane is observed, as shown in FIG. 11*b* with respect to the radiation pattern of FIG. 11*a* corresponding to a conventional handset with no EBS.

In the embodiments of FIGS. 6 and 10 at least one edge of one conducting surface (4,4') and at least one edge of the ground plane (1), are lying on a plane which is substantially perpendicular to the ground plane (1).

There are many ways the EBS can be put into practice within the scope and spirit of the invention. Generally any kind of conducting structure of the proper length (about a quarter wavelength or an odd multiple of a quarter wavelength) including a shorting means can be used. For instance, and without any limiting purpose, an EBS is formed by two stamped L-shaped conducting plates which are connected to the ground PCB at their shorted edge. Any conducting material such as copper, brass, tin or lead could be for instance applied to build the plates. Also, such plates could be made of a plastic covered or melted with a layer of conducting material, such as a conducting electromagnetic interference (EMI) blocking paint or similar. The EBS requires a part of the structure being grounded, a part of it being in open circuit, and the distance between such a short or ground being around one quarter wavelength to resonate in a high-impedance mode.

A particular way of implementing the EBS is by using two layers on a multilayer Printed Circuit Board (PCB). Two conducting plates defining the conducting surfaces (4,4'), are printed on two layers including the ground plane (1) in between, such a two plates being connected to ground by means of any grounding technique, such as for instance metallized via holes on the multilayer substrates.

The EBS can be placed at one or both sides of the ground plane. Although generally a two-sided configuration is preferred, in some cases where there are some mechanical constrains that make such a configuration difficult, a single-sided solution is also possible, by placing the EBS structure or a part of it on the side of the ground plane (1) with more significant contribution on the radiation pattern.

Also, the shape of such an EBS does not necessarily need to be planar and rectangular. In general, any shape can be taken, as long as one region of the EBS conductor is shorted to ground an the rest of it is left open towards the region where propagating electromagnetic waves and currents are to be blocked. The conducting surface structure for the EBS can be made conformal to any other part of the handset. For instance, in another preferred embodiments, the EBS is made by coating the internal plastic cases of a handset (front and back covers) with a layer of conducting paint or ink, such as for instance an EMI blocking material, said coating being grounded for instance by means of a conductive paste or ink reaching a metal pad or ground region on the ground plane (1).

Therefore, the conducting surfaces (4,4') of the EBS are lying on a planar or curved surface, or in other embodiments some areas of the conducting surfaces may be planar and other parts can be curved areas to conform a particular part of the handset. The planar parts of the conducting surfaces (4,4'), are preferably substantially parallel to the ground plane (1).

The conducting surfaces (4,4') are placed at a suitable distance from the ground plane. In the present invention one preferred value for said distance, is any value within the range 0.8 millimetres to 2 centimetres.

It will be seen that the short circuit (5,5') does not necessarily need to be a physical short on the metal piece. A virtual RF short, i.e. a very low impedance element at RF frequencies are possible as well. For instance, a high capacitance components or capacitive structures can be used to implement the short to ground.

In another preferred embodiment of the invention, it is possible to replace the short by a second quarter-wavelength section (or an odd multiple of a quarter wavelength) with a first end connected at the point where the virtual short is required, said second section featuring also an open circuit at a second end. This way, the combination of the quarter wavelength size and the open circuit at the second end, provides the required RF short at said first end.

The EBS does not necessarily need to be a completely solid metallic structure. For some manufacturing, cost or weight reasons, several clearances on the plates defining the conducting surfaces can be included. These can take the form of holes on the EBS plates, or uncoated regions on the handset back cover, or alike when the conducting surfaces are implemented by means of a layer of a conducting paste, paint or ink. For instance, the EBS can be implemented with a mesh or grid of wires or strips.

Figure 12:
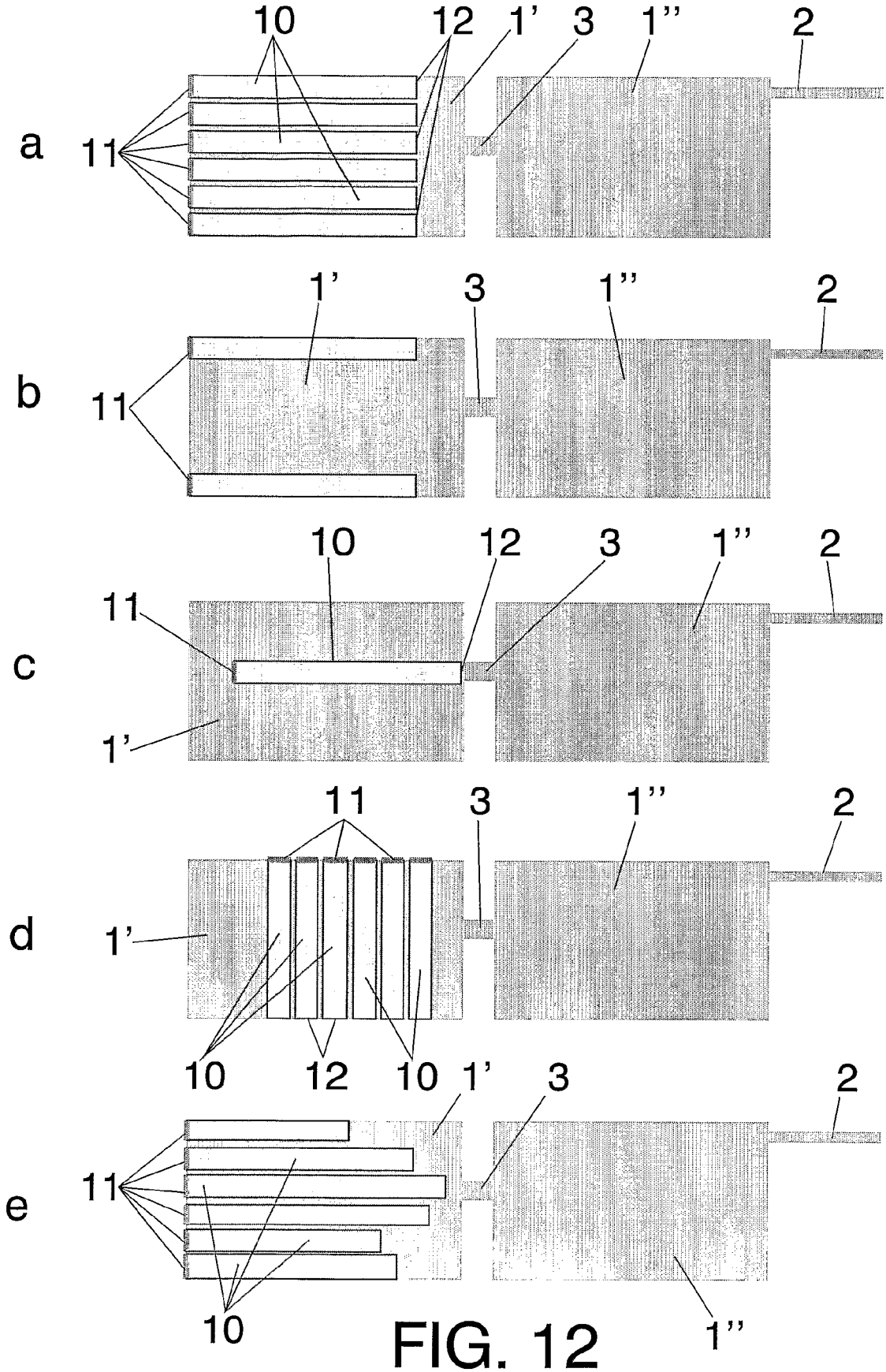
FIG. 12.—shows top views of several forms of EBS. From top to down.

Another way of implementing an EBS is by using an array of strips (10), with one end (12) of the strip connected to the ground plane (1), and the opposite end (12) being left in open circuit. These strips (10) are narrower than the ground plane and can be arranged parallel or perpendicular to a handset vertical axis (x) in a rib-like structure. In the case of clamshell phones, where current mainly flows from a conducting part of the ground plane to the other through flexible interconnecting strips (3), a single narrower strip (10), as shown in FIG. 12*c*, can be used to block or partially block, at least a part of the current and waves flowing from one conducting part of the ground plane to the other as well. In this case, the open end (12) of the strip (10) will be preferably placed in the area around the interconnection between the two conducting parts (1',1") of the ground plane. In the embodiment of FIG. 12*c*, the conducting strip (10), aligned with the conducting strip (3), has approximately the same width of the conducting strip (3), and it is electrically connected to an inner part of the first conducting part (1') of the ground plane (1). In the other embodiments of FIG. 12, the strips (10) are short-circuited to one edge of the ground plane by means of an electrical connection (11).

In those cases where main of the current propagates along the edge of the ground plane, a single strip or several strips (10) at both edges of the ground plane can be placed as well, as shown in the embodiment of FIG. 12*b*. Also, when the radiation pattern lobes are to be raised or modified at several frequencies, several strips (10) of several lengths can be used as shown in the embodiment of FIG. 12*e*, or even a single wide plate with a conformal contour.

Stacking and nesting several EBS for several frequencies (with several lengths) is also possible within the scope and spirit of the present invention, that is several strips (10) of different length, can be stacked in planes separated at different distances from the ground plane.

Again, the RF short does not need to be a physical short to ground, it can be provided by a high capacitance structure or component such as a capacitor, a metal plate close to ground or a resonant transmission line or stub. For instance, another quarter-wavelength strip wit one open end will introduce an effective short at the opposite end. This can be advantageous in those devices where, for any reason it is mechanically or industrially difficult or costly to provide a physical short to ground. In those cases, the quarter wavelength EBS structure might be replaced by a half-wavelength structure (or an entire multiple of a half-wavelength structure) with two opens at both ends.

In some devices where there exits a ground plane (1) formed by a first and a second conducting part (1',1"), with an electrical interconnection (3) between them, it is advantageous to block the currents flowing from one part of the ground plane to the other just at the interconnection point or points. This can be achieved for instance by placing a strip or transmission line with an open end facing said interconnection. Other equivalent means such as two-paralell quarter-wavelength structures connected at the open end is also possible. This is shown in FIG. 13*a* which displays a 'U' shaped structure, each arm (13,13') of the U featuring about a quarter wavelength and a short (11) to the ground plane (1) at one end of each arm (13,13'). Both arms (13,13') are connected together to a common strip which forms an extension (14) that faces the interconnection (3) between the two parts (1',1") of the ground plane, which effectively provides an open circuit that stops currents flowing from one part of the ground plane to the other.

Again, as it is shown in FIG. 13*b*, quarter wavelength structures can be replaced by half-wavelength structures with two open ends instead of an open end an a shorted end. In the embodiment of FIG. 13*b* the conducting strip (10) is formed by two side arms (15,15') connected by a common arm (16) which is provided with an extension (14) facing the conducting strip (3).

The rib-like structure in FIG. 12 effectively introduces a periodic or quasi-periodic structure in the direction of propagation of waves from top to down. Periodic and quasi-periodic structures can be used to modify the propagation characteristics of electromagnetic waves. In particular, they can be used to block and reject waves within a range of frequencies. Periodic structures are used in electromagnetic devices in the form of photonic or electromagnetic band-gap structures (PBG or EBG), frequency selective surfaces (FSS), and metamaterials.

Periodic structures can be used also to implement an EBS in a handheld device. A periodic arrangement of conducting or dielectric patterns, connected or not to the PCB ground or other ground of the handset is used also to make an effective EBS. Such a periodic EBS (PEBS) can be implemented, for instance, by coating a region on the front and/or back cover of the handset with a set of strips or other conducting patterns, such as for instance a tile of polygons, a tile of space-filling or multilevel shapes (see for instance patent publication WO0122528 and WO0154225 for multilevel and space-filling structures), fractal or meander shapes. Therefore, in some embodiments a part of at least one conducting surface and/or a part of the ground plane is a multilevel structure or a space-filling curve.

Another PEBS is built by shaping at least a portion of the ground-plane on the PCB with such a periodic set of slots or gaps. These slots take the form of for instance narrow strips, space-filling, multilevel, fractal or meander shapes.

An embodiment for a PEBS is made by tiling at least one layer of a multilayer PCB of the handset with a set of shaped conductive pads (said patterns being for instance polygonal, multilevel or space-filling). These pads are optionally connected to ground, for instance by means of one or several conducting via-holes. Also, such a tile of shaped pads can be arranged at both sides of the PCB ground, or even in multiple layers at both sides of the ground, to arrange a single-frequency or multiple-frequency PEBS.

Another construction of an EBS consists on a conformal arrangement of a shape or set of shapes on the ground-plane on at least one of the PCBs of the handset. Such a construction can take the form of for instance a structure as described in the PCT publication WO03023900.

Figure 13:
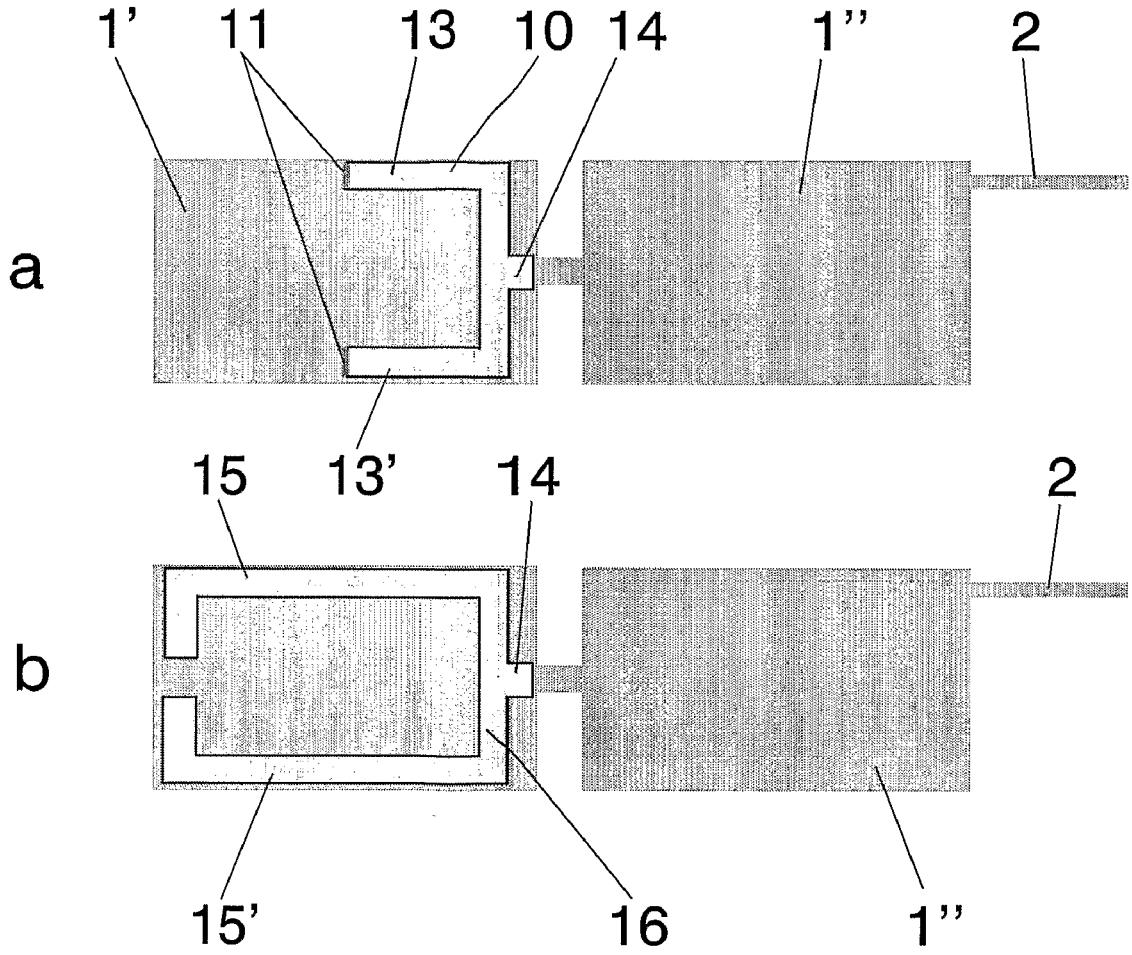
FIG. 13.—shows in FIG. 13*a* a top view of an EBS structure made of two parallel stubs interconnected at one open end. Said open end is facing the interconnection between the two PCBs. The strips can be made a quarter-wavelength with a short at one end (FIG. 13*a*), or half a wavelength with both ends in open circuit (FIG. 13*b*).

In the embodiments of FIGS. 12 and 13 only one side of the ground plane (1) is shown. Preferably, the other side of the ground plane (1), comprises also conducting surfaces (4,4') defined by strips (10) which are a mirror image of the strips (10) shown on said FIGS. 12 and 13.

Further embodiments of the invention are described in the dependent claims.

The invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A handset for radio communication, the handset comprising:

an antenna;

a ground plane associated with the antenna the antenna being situated in correspondence with an antenna end of the ground plane;

at least one conducting surface situated over a part of the ground plane and separated from the part of the ground plane by a distance of 0.8-20 mm;

the at least one conducting surface being arranged so that the part of the ground plane and the at least one conducting surface, in combination, establish a resonance circuit having a high impedance at an operating frequency of the antenna, towards the antenna end of the ground plane.

2. The handset according to claim 1, wherein the at least one conducting surface is short-circuited to the ground plane at a position situated at a distance from an end of the conducting surface facing the antenna end of the ground plane, the distance being such that it corresponds to an electric path length of substantially one quarter of the wavelength at the operating frequency, or an odd multiple of a quarter of the wavelength.

3. The handset according to claim 2, wherein the at least one conducting surface is short-circuited to the ground plane via at least one of:

a metallic connection;

a capacitive component having low impedance at RF frequencies;

conductive paint;

conductive paste; and conductive ink.

4. The handset according to claim 1, wherein the at least one conducting surface is not short-circuited to the ground plane, the at least one conducting surface being arranged such that the resonance circuit has a first open end facing the antenna end of the ground plane and a second open end separated from the first open end by a distance corresponding to an electrical path length substantially equal to half of the wavelength or a multiple of the half of the wavelength, at the operating frequency.

5. The handset according to claim 1, wherein the ground plane defines an outer perimeter and wherein the at least one conducting surface is short-circuited to the perimeter of the ground plane or to an inner part of the ground plane.

6. The handset according to claim 1, comprising at least one conducting surface over each side of the ground plane.

7. The handset according to claim 6, wherein at least one conducting surface over one side of the ground plane is a mirror image of another conducting surface placed over the other side of the ground plane.

8. The handset according to claim 1, wherein the at least one conducting surface is defined by a conducting plate or by a layer of conducting material comprising at least one of:

conducting paint, conducting ink, and conducting paste.

9. The handset according to claim 8, wherein the handset comprises a cover made of non-conducting material and the conducting paint, paste or ink is coated on a face of the cover.

10. The handset according to claim 1, wherein at least one edge of one conducting surface and at least one edge of the ground plane are lying on a plane substantially perpendicular to the ground plane.

11. The handset according to claim 1, wherein at least one part of the at least one conducting surface is substantially parallel to the ground plane.

12. The handset according to claim 1, wherein the ground plane comprises a first conducting part and a second conducting part, the first and second conducting parts being electrically connected by at least a conducting strip, the at least a conducting strip being narrower than the width of any of the first and second conducting parts.

13. The handset according to claim 12, wherein the first and the second part of the ground plane are substantially rectangular.

14. The handset according to claim 13, wherein the at least one conducting surface has the same width as the first or the second part of the ground plane.

15. The handset according to claim 13, wherein the at least one conducting surface is narrower than the ground plane.

16. The handset according to claim 12, wherein the at least one conducting surface comprises a first end short-circuited to the ground plane and a second end which is an open circuit and is facing the conducting strip.

17. The handset according to claim 1, wherein the at least one conducting surface is substantially rectangular.

18. The handset according to claim 17, wherein the at least one conducting surface is aligned with the conducting strip.

19. The handset according to claim 1, comprising an array of two or more conducting surfaces narrower than the ground plane, the two or more conducting surfaces arranged parallel or perpendicular with respect to a ground plane longitudinal axis.

20. The handset according to claim 19, wherein the conducting surfaces have at least one of a different length and different width.

21. The handset according to claim 19, wherein the array of conducting surfaces is a periodic structure.

22. The handset according to claim 1, wherein:

the at least one conducting surface is U-shaped and has two side arms;

each side arm features an electrical length of substantially a quarter wavelength at the operating frequency;

the side arms are short-circuited at their ends to the ground plane, and the at least one conducting surface comprises an extension facing the conducting strip.

23. The handset according to claim 1, wherein:

the at least one conducting surface comprises two side arms having each arm an end in open circuit;

each arm features an electrical length of substantially half of wavelength at the operating frequency; and the at least one conducting surface comprises an extension facing the conducting strip.

24. The handset according to claim 1, wherein:

at least one of the conducting surfaces and the ground plane is a conducting layer of a multilayer printed circuit board; and the ground plane layer is located in between the conducting surfaces.

25. The handset according to claim 24 wherein the at least one conducting surface is short-circuited to the ground plane via a metallized via hole in the printed circuit board.

26. The handset according to claim 1, wherein the handset is a clamshell or flip-phone handset.

27. The handset according to claim 1, wherein a part of at least one of at least one conducting surface and a part of the ground plane is a multilevel structure or a space-filling curve.

28. A clamshell handset comprising:

an electromagnetic bra structure at least at one half of the handset phone wherein the electromagnetic bra structure comprises two conducting plates;

the plates being placed at both sides of a ground plane of the clamshell handset;

both of the plates being connected at least at one point of the handset;

the plates being a quarter wavelength in length or an odd multiple of a quarter wavelength;

wherein the clamshell handset has formed therein an opening nearby a hinge of the clamshell phone.

29. A method of producing a handset comprising:

arranging at least one conducting surface over a part of a ground plane and separated from the part of the ground plane by 0.8-20 mm; and wherein the part of the ground plane and the at least one conducting surface, in combination, establish a resonance circuit having a high impedance at an operating frequency of the antenna, towards an antenna end of the ground plane.

* * * * *